US007726048B2

(12) United States Patent
Stanek et al.

(10) Patent No.: US 7,726,048 B2
(45) Date of Patent: Jun. 1, 2010

(54) AUTOMATED MACHINE REPOSITIONING IN AN EXCAVATING OPERATION

(75) Inventors: Daniel Stanek, Chillicothe, IL (US); Roger D. Koch, Pekin, IL (US); Jeffrey S. Alig, Metamora, IL (US); Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 574 days.

(21) Appl. No.: 11/606,166

(22) Filed: Nov. 30, 2006

(65) Prior Publication Data

US 2008/0127531 A1 Jun. 5, 2008

(51) Int. Cl.
*E02F 1/00* (2006.01)

(52) U.S. Cl. ..... 37/195; 37/466

(58) Field of Classification Search ..... 37/348, 37/466, 195, 347; 172/2–11; 701/23, 25, 701/26, 50

See application file for complete search history.

(56) References Cited

U.S. PATENT DOCUMENTS

| | | | | |
|---|---|---|---|---|
| 3,339,763 | A | | 9/1967 | Caywood et al. |
| 4,015,729 | A | | 4/1977 | Parquet et al. |
| 4,140,144 | A | | 2/1979 | Dowd et al. |
| 4,288,196 | A | | 9/1981 | Sutton, II |
| 4,531,883 | A | | 7/1985 | Arnold |
| 4,677,555 | A | | 6/1987 | Goyet |
| 4,869,337 | A | | 9/1989 | Wagner |
| 5,065,326 | A | | 11/1991 | Sahm |
| 5,138,756 | A | | 8/1992 | Johnson et al. |
| 5,347,448 | A | | 9/1994 | Nam |
| 5,528,843 | A | | 6/1996 | Rocke |
| 5,546,093 | A | | 8/1996 | Gudat et al. |
| 5,699,247 | A | | 12/1997 | Moriya et al. |
| 5,704,429 | A | * | 1/1998 | Lee et al. ..... 172/4.5 |
| 5,806,016 | A | | 9/1998 | Henderson et al. |
| 5,854,988 | A | | 12/1998 | Davidson et al. |
| 6,061,617 | A | * | 5/2000 | Berger et al. ..... 701/50 |
| 6,062,317 | A | | 5/2000 | Gharsalli et al. |
| 6,076,030 | A | | 6/2000 | Rowe |
| 6,108,949 | A | | 8/2000 | Singh et al. |
| 6,131,062 | A | | 10/2000 | Nielsen |
| 6,167,336 | A | | 12/2000 | Singh et al. |
| 6,223,110 | B1 | | 4/2001 | Rowe et al. |
| 6,234,254 | B1 | | 5/2001 | Dietz et al. |
| 6,247,538 | B1 | | 6/2001 | Takeda et al. |
| 6,292,729 | B2 | | 9/2001 | Falck et al. |

(Continued)

FOREIGN PATENT DOCUMENTS

| | | |
|---|---|---|
| EP | 0 616 275 | 9/1994 |

(Continued)

*Primary Examiner*—Robert E Pezzuto
(74) *Attorney, Agent, or Firm*—Finnegan, Henderson, Farabow, Garrett & Dunner

(57) ABSTRACT

A method of repositioning a machine during an excavating operation from a first machine position to a second machine position is provided. A target distance to the second machine position is selected. An operator input device configured to send a control input signal to a control module to initiate a repositioning phase is activated. During a repositioning phase, the machine is moved toward the second position while an operator maintains control of movement. A determination is made when the machine has traveled the target distance. The machine is stopped under automated machine control at the second machine position.

7 Claims, 8 Drawing Sheets

U.S. PATENT DOCUMENTS 6,354,023 B1 3/2002 Trahan et al.
6,363,632 B1 4/2002 Stentz et al.
6,371,214 B1 4/2002 Anwar et al.
6,418,364 B1 7/2002 Kalafut et al.
6,430,850 B1 8/2002 VanDerZyl et al.
6,510,628 B1 1/2003 Koch
6,539,294 B1 * 3/2003 Kageyama ..... 701/23
6,542,789 B2 4/2003 Ufheil
6,604,305 B2 8/2003 Koch
6,609,315 B1 8/2003 Hendron et al.
6,643,576 B1 11/2003 O Connor et al.
6,643,577 B1 11/2003 Padgett et al.
6,658,767 B2 12/2003 Kelly et al.
6,691,010 B1 2/2004 Gay
6,701,239 B2 3/2004 Keefer
6,718,244 B2 4/2004 Lin et al.
6,725,142 B2 4/2004 Koch
6,732,458 B2 5/2004 Kurenuma et al.
6,736,216 B2 5/2004 Savard et al.
6,757,994 B1 7/2004 Hendron
6,763,619 B2 7/2004 Hendron et al.
6,813,557 B2 * 11/2004 Schmidt et al. ..... 701/200
6,819,993 B2 11/2004 Koch
6,851,495 B2 2/2005 Sprinkle et al.
6,879,899 B2 4/2005 Budde
6,907,336 B2 6/2005 Gray et al.
6,915,599 B2 7/2005 Lohnes et al.
6,934,615 B2 8/2005 Flann et al.
6,954,999 B1 10/2005 Richardson et al.
6,980,895 B2 12/2005 Paice et al.
7,007,415 B2 3/2006 Koch
7,010,367 B2 3/2006 Koch et al.
7,010,425 B2 3/2006 Gray et al.
7,032,703 B2 4/2006 Wulfert et al.
2005/0209759 A1 9/2005 Lee
2006/0021819 A1 2/2006 Shearer
2006/0034535 A1 2/2006 Koch et al.
2006/0064221 A1 3/2006 Sporer et al.
2006/0089773 A1 4/2006 Hendron et al.
2006/0090379 A1 5/2006 Furem
2006/0095186 A1 5/2006 Hendron et al.
2006/0137931 A1 6/2006 Berg et al.

FOREIGN PATENT DOCUMENTS

EP 1 526 221 4/2005
EP 1 650 359 4/2006
GB 2 392 147 2/2004
GB 2 412 362 9/2005
JP 5-297942 11/1993

* cited by examiner

AUTOMATED MACHINE REPOSITIONING IN AN EXCAVATING OPERATION

TECHNICAL FIELD

This disclosure relates to automated machine repositioning in an excavating operation and, more particularly, to a method and a system for at least partially automating actions involved in repositioning an excavating machine during an excavating operation.

BACKGROUND

Many machines have been developed for excavating. One commercially available type of machine often used for excavating, for example in a trenching operation, is a backhoe. Generally, a backhoe is mounted on a tractor or other machine body moveable along the ground on wheels or tracks. The backhoe may be the only excavating assemblage or handling implement on the tractor or machine body, or it may be one of a plurality of implements. For example, one relatively common machine, generally known as a backhoe loader, may include a backhoe mounted at one end of a tractor, and may include a loader bucket and accompanying operating linkage mounted at the other end of the tractor.

A typical backhoe may include a boom, a stick, and a bucket. In general, the boom may be pivoted to the machine for movement in a generally vertical plane, the stick may be pivotally mounted to the boom for movement in the same generally vertical plane, and the bucket may be pivotally mounted to the stick. The stick may be a fixed length element or it may be of the extendable, e-stick type. Each of the boom, stick, and bucket may be moved about a pivotal connection by one or more actuators, such as hydraulic cylinders. The entire excavating assemblage of boom, stick, and bucket may be mounted on the machine body for swinging movement in a generally horizontal plane relative to the machine body.

Another relatively common machine that employs a backhoe-type implement is generally known as a hydraulic excavator. A hydraulic excavator may have a number of features in common with the backhoe of a backhoe loader. For example, a hydraulic excavator may include a boom, a stick, and a bucket as the excavating assemblage. However, in a hydraulic excavator, the excavating assemblage does not swing in a horizontal plane relative to the machine body as does the excavating assemblage in a backhoe loader. Rather, in a hydraulic excavator, the entire upper machine body rotates relative to an undercarriage. Thus, the position of the excavating assemblage on a worksite in a relatively horizontal plane is altered by rotating the entire upper machine body.

In excavating a trench, for example, the operator of a machine, such as a backhoe, manipulates the machine controls to cause the boom, stick, and bucket to move in coordination such that the bucket digs into the earth generally along the direction of extent of the proposed trench. The bucket is moved about its pivot to become filled with earth, and the filled bucket is held in a curled position relative to the stick and lifted by coordinated movement of the boom and stick from the trench being formed. The excavating assemblage of boom, stick, and bucket is then swung away from the trench for dumping, either into a pile adjacent the trench, or into a waiting container or carrier, such as a dump truck.

A proposed excavation may be larger in extent than the reach from a single set-up position of the machine that is selected to create the excavation. For example, where a backhoe loader is selected to excavate a trench of some defined length, the backhoe loader may be capable of excavating only a portion of the trench from a single set-up position of the backhoe loader. In order to complete the assigned trench, after trenching to the extent of the reach of the backhoe, it becomes necessary to move the machine to a new set-up position so that excavating can continue and the trench can be completed. Often, it may be necessary to repeat this process several times where the proposed trench has a length several time the working reach of the machine performing the excavating operation.

The movement of a machine during a trenching operation, from one set-up position to another, may be referred to in a number of ways. For example, the movement may be referred to as a "hop," or it may be referred to simply as a repositioning. Regardless of the name assigned to this movement to new set-up positions between excavating phases, the movement entails a number of particular acts and requires a significant measure of skill and careful attention by the machine operator. For example, where the machine of choice for a trenching operation is a backhoe loader, the operator may be required to separately manipulate controls to alter engine speed, lift the loader bucket from ground engagement, retract machine stabilizers, alter engine speed again for engagement of a transmission gear, move the tractor or machine a proper distance for set-up at a new position, etc.

Since the excavating assemblage of a backhoe loader is mounted at the rear of the tractor, the operator generally is seated and facing to the rear during an excavating phase, with the front of the tractor facing generally in the direction of the proposed (but not yet excavated) trench. For movement to a new set-up position, the operator must at some point reposition himself to face toward the front of the tractor, usually by swiveling the operator seat from a rear facing orientation to a front facing orientation. Controls for the backhoe, and perhaps the stabilizers, may be located convenient to the rear-facing direction, while controls for the loader bucket, steering, engine throttle, and brake may be located convenient to the front-facing direction.

Time may be lost in the individual performance by the operator of the several steps involved in machine movement. Swiveling between the rear facing and front facing positions to individually manipulate the several controls involved in movement to a new set-up position may be yet one more factor contributing to operator fatigue. Relying on the operator to determine the appropriate movement distance may not yield the most efficient repositioning of the tractor. It is desirable to maximize productivity by, for example, minimizing the number of machine repositionings, or hops, during an excavating operation by, for example, minimizing the repositioning or hop distance between excavating phases. Some efficient and effective manner of addressing these issues would be both beneficial and desirable.

U.S. Pat. No. 6,371,214 to Anwar et al. discloses a system and method for automating work machine functions that are performed on a repetitive basis. In the Anwar et al. patent, automated work functions available include an auto lift, auto dump, and auto return to dig work function. Particular machine contexts for automated work functions disclosed in the Anwar et al. patent include a wheel loader and a hydraulic excavator. The Anwar et al. patent states that the controller can be programmed to cause the machine to move from a current location into another location.

While the arrangement in the Anwar et al. patent may disclose automation of some work machine functions, the Anwar et al. patent does not recognize the adverse contribution to productivity that machine repositioning may have on the overall efficiency of an excavating operation. In addition, the Anwar et al. patent does not disclose any particulars regarding machine repositioning or inefficiencies that may be incurred during machine repositioning. Furthermore, the Anwar et al. patent does not disclose automation of the series of actions which may be included in a machine repositioning phase that may occur between excavating phases of an excavating operation. Autonomous operation is difficult and expensive to achieve and, by itself, does not aid or serve as a solution to execution of machine repositioning.

The disclosed embodiments are directed toward improvements and advancements over the foregoing technology.

SUMMARY OF THE INVENTION

In one aspect, the present disclosure is directed to a method of repositioning a machine during an excavating operation from a first machine position to a second machine position. The method includes selecting a target distance to the second machine position. The method also includes activating an operator input device configured to send a control input signal to a control module to initiate a repositioning phase. The method further includes, during the repositioning phase, moving the machine toward the second position while maintaining operator control of movement, and determining when the machine has traveled the target distance. The method also includes stopping the machine under automated machine control at the second machine position.

In another aspect, the present disclosure is directed to a system for control of repositioning an excavator from a first set-up position from which a first excavating phase occurs, to a second set-up position from which a second excavating phase occurs. The system includes an excavating assemblage. The system also includes a control system including an input device configured to be selectively programmed to be manipulated by an operator to initiate and control machine movement during a repositioning phase, and a control module configured to deliver an output signal to stop the excavator at the second set-up position under automated machine control.

DETAILED DESCRIPTION

Figure 1:
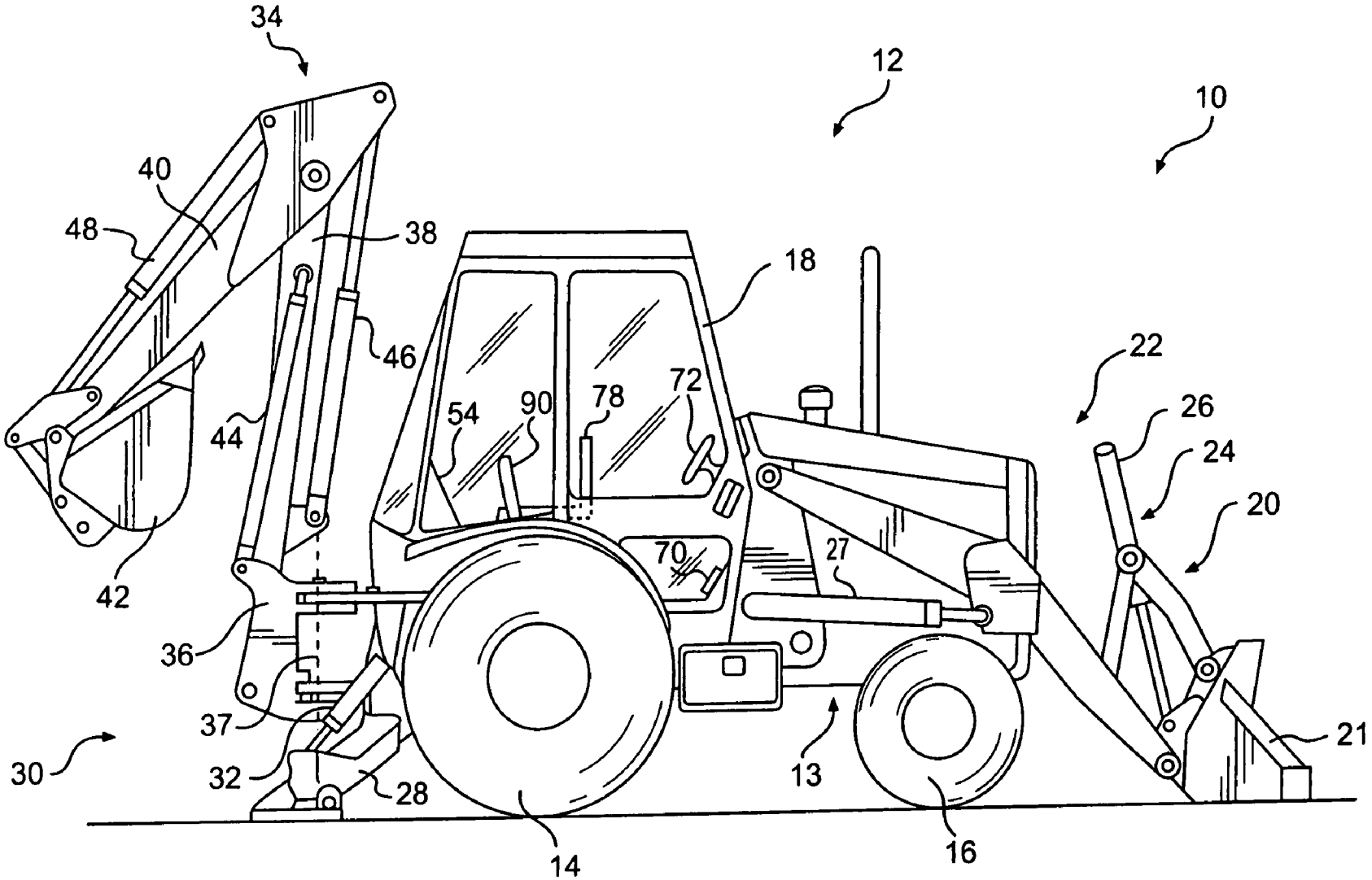
FIG. 1 is a generalized representation of a backhoe loader according to an exemplary disclosed embodiment.

FIG. 1 illustrates an exemplary backhoe loader 10 that may be employed in connection with embodiments of the disclosure. Backhoe loader 10 may include a machine, such as a tractor 12. Tractor 12 may include a chassis 13 and a ground transportation assembly, including a pair of rear wheels 14 and a pair of front wheels 16 mounted to chassis 13. It should be understood that, instead of wheels 14 and 16, the tractor 12 could be provided with a pair of tracks or other structure to permit ground transportation. Backhoe loader 10 also may include a cab 18 or other suitable facilities to accommodate an operator and to house machine controls.

The backhoe loader 10 may include a front loader assembly 20 including a loader bucket 21 at a front end 22 of the tractor 12, and suitable operating linkage 24 for manipulation of the loader bucket 21 under the control of actuators 26 and 27, such as hydraulic cylinders. The backhoe loader 10 may include a pair of stabilizers, one of which is shown at 28 in FIG. 1. While one stabilizer is illustrated in FIG. 1, it will be understood that a similar stabilizer may be similarly mounted at the opposite side of the tractor 12 as can readily be seen by reference to FIG. 3. Both stabilizers 28 are mounted adjacent a rear end 30 of tractor 12. The stabilizers 28 may be hydraulically controlled (for example via hydraulic cylinder 32) in a relatively conventional manner to swing between a retracted, stored position out of ground contact, and an extended, deployed position in which they contact the ground.

The backhoe loader 10 may also include an excavating assemblage 34, for example, a backhoe mechanism, at the rear end 30 of the tractor 12. The excavating assemblage 34 may include a suitable swing assembly 36 for permitting the backhoe mechanism to swing about an axis designated 37 from one side of the tractor 12 to the other. The swing assembly 36 may move under the control of one or more hydraulic cylinders (not shown) about the axis 37, and may serve to move the excavating assemblage 34 from an excavating position to a dumping position, for example.

The excavating assemblage 34 may include a boom 38 having a first end pivotally mounted adjacent the tractor 12 for movement in a generally vertical plane. A stick 40 may have a first end pivotally mounted adjacent the second end of the boom 38 for movement in the same generally vertical plane in which the boom 38 may move. An excavating implement, for example, in the form of a bucket 42, may be pivotally mounted at a second end of the stick 40 for pivotal movement in the same generally vertical plane in which the boom 38 and stick 40 may move. The boom 38 may be pivotally moved under the control of a hydraulic cylinder 44. The stick 40 may be pivotally moved under the control of a hydraulic cylinder 46. The bucket 42 may be pivotally moved under the control of a hydraulic cylinder 48.

Figure 2:
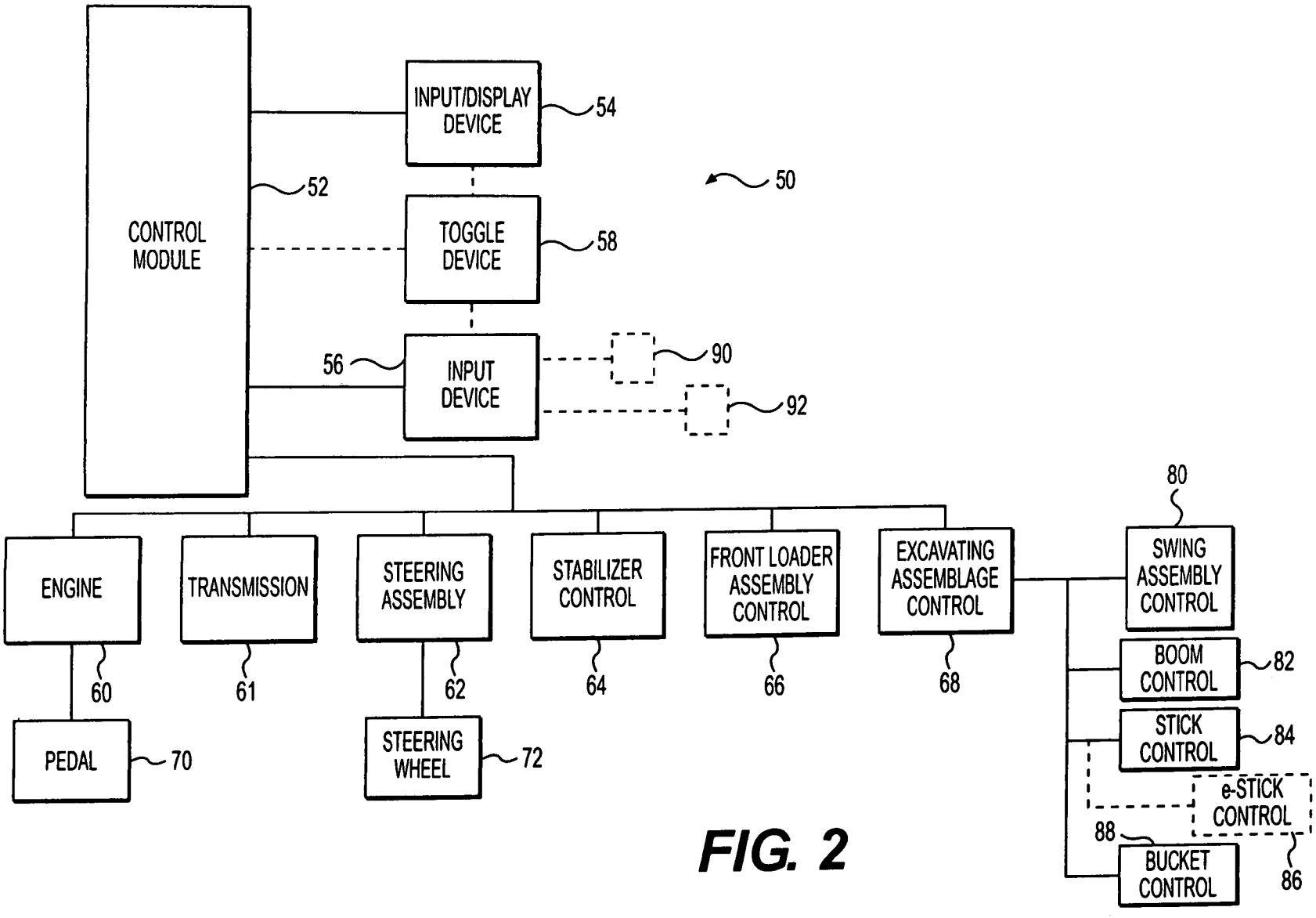
FIG. 2 diagrammatically illustrates an exemplary embodiment of a control system.

FIG. 2 illustrates one exemplary control system 50 that may be employed in connection with disclosed embodiments. Control system 50 may include a suitable control module 52 (e.g., an electronic control module, or ECM) which, in turn, may include a suitable programmable memory and a processor. Control module 52 may be located in cab 18 of tractor 12. An input/display device 54 may be suitably associated with the control module 52 and configured to permit an operator to input data. For example, input/display device 54 may be a touch screen display device, or touch-sensitive display screen, generally known, but suitably configured for purposes to be described herein.

Input/display device 54 may be positioned at a suitable location such that an operator may readily view it and access it, but will be unlikely, via input/display device 54, to inadvertently activate a particular mechanism or control a particular function. In other words, input/display device 54 is so located as to increase the probability that activation of input functions will occur only upon purposeful intervention by the operator rather than by inadvertence. Such a touch screen may be suitably configured to permit input and display of a wide array of information associated with control and operation of backhoe loader 10. Additionally, suitable flags may appear on the touch screen to convey safety information to the operator. For example only, a suitable flag may indicate whether the machine brakes are locked.

An input device 56 and a toggle device 58 also may be associated with control module 52. Input device 56 may be one or more joysticks, keyboards, levers, or other input devices known in the art. For example, input device 56 may include left joystick 90 (seen also in FIG. 1) and right joystick 92. Toggle device 58 may be employed to alter the mode of input device 56, which may include altering the mode of one or both of joysticks 90, 92. Thus, in one mode, input device 56 may be a joystick configured to control manipulation of the various articulated elements of excavating assemblage 34. In another mode, the same joystick may be configured to control steering and propulsion of tractor 12. Toggle device 58 may be, for example, a switch, button, lever, etc., which may be suitably mounted on a control panel within cab 18. In one embodiment, toggle device 58 may be mounted on a joystick, where input device 56 is a joystick. In another exemplary embodiment, toggle device 58 may be a virtual button that an operator may access and activate on a touch screen display constituting the input/display device 54. The virtual button may be an icon, a picture, an image, or any other computer generated representation that may appear on a touch screen display and be subject to activation by an operator.

In another exemplary embodiment, input device 56 may include at least two joysticks, such as joysticks 90, 92, that may be employed in connection with operation of the front loader assembly 20. For example, with the operator seat 78 positioned facing in a forward direction, an operator may control movement and steering of the tractor 12 with one joystick, such as the one positioned to the left of the operator, and an operator may control the manipulation of the front loader assembly with the other joystick, such as the one positioned to the right of the operator. Alternatively, the control functions of the two joysticks could be reversed, with the left joystick controlling the front loader assembly manipulation and the right joystick controlling tractor movement and steering.

Control module 52 may be suitably configured to receive signals from and send signals to all the various subassemblies and elements of the backhoe loader 10. For example, referring to the exemplary and diagrammatically illustrated control system of FIG. 2, control module 52 may send signals to and receive signals from engine 60 to control engine speed, transmission 61 to control shifting of gears, steering assembly 62 to control machine steering, stabilizer control 64, front loader assembly control 66, and excavating assemblage control 68. Excavating assemblage control 68 may include swing assembly control 80, boom control 82, stick control 84, optional e-stick control 86, and bucket control 88. As is generally known, engine speed may be manually regulated by an operator via, for example, a pedal 70. Similarly, steering may be manually regulated by an operator via, for example, a steering wheel 72.

Figure 3:
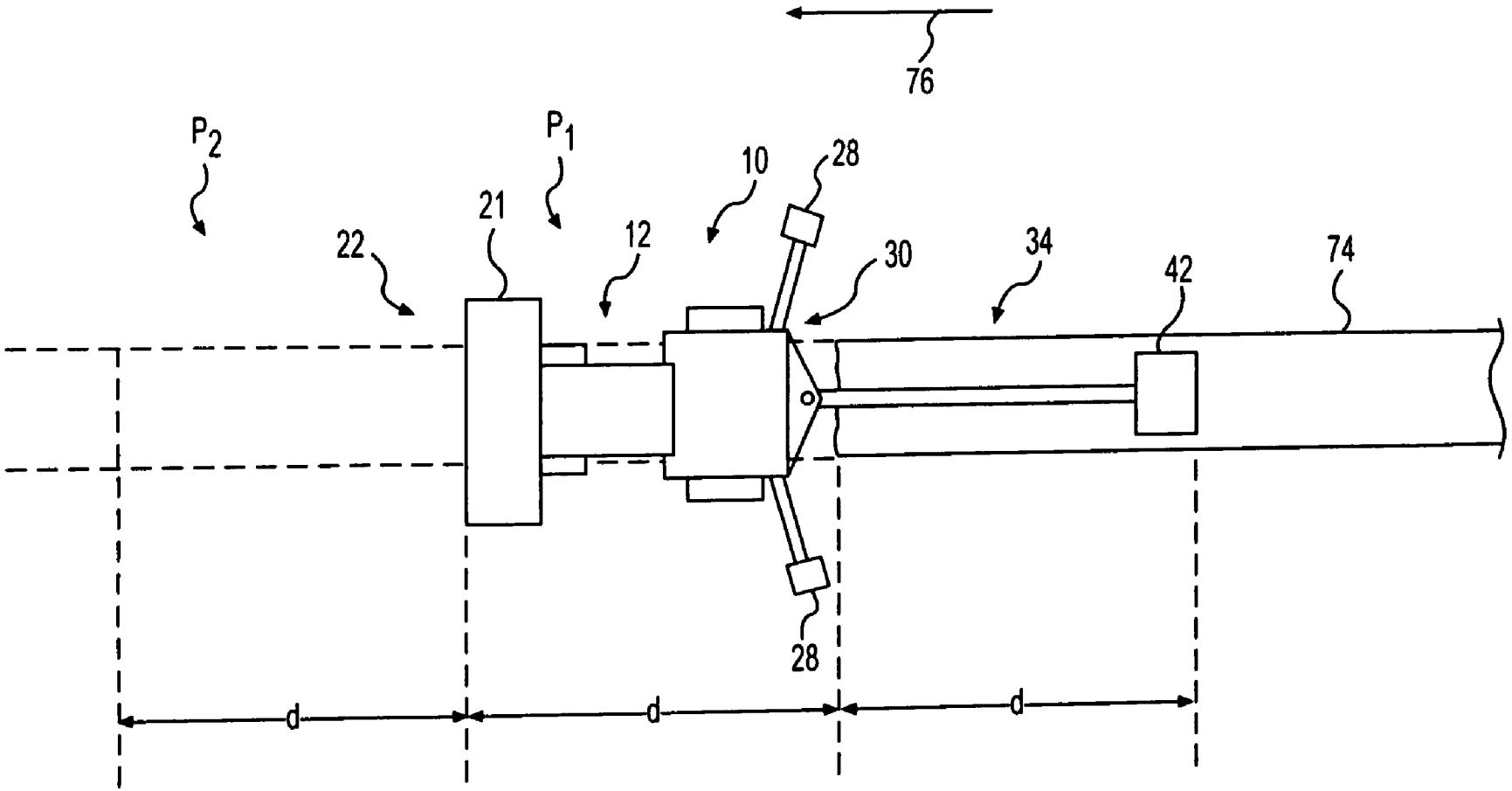
FIG. 3 is a schematic view of a backhoe loader in the process of excavating an elongated trench according to an exemplary disclosed embodiment.
Figure 4:
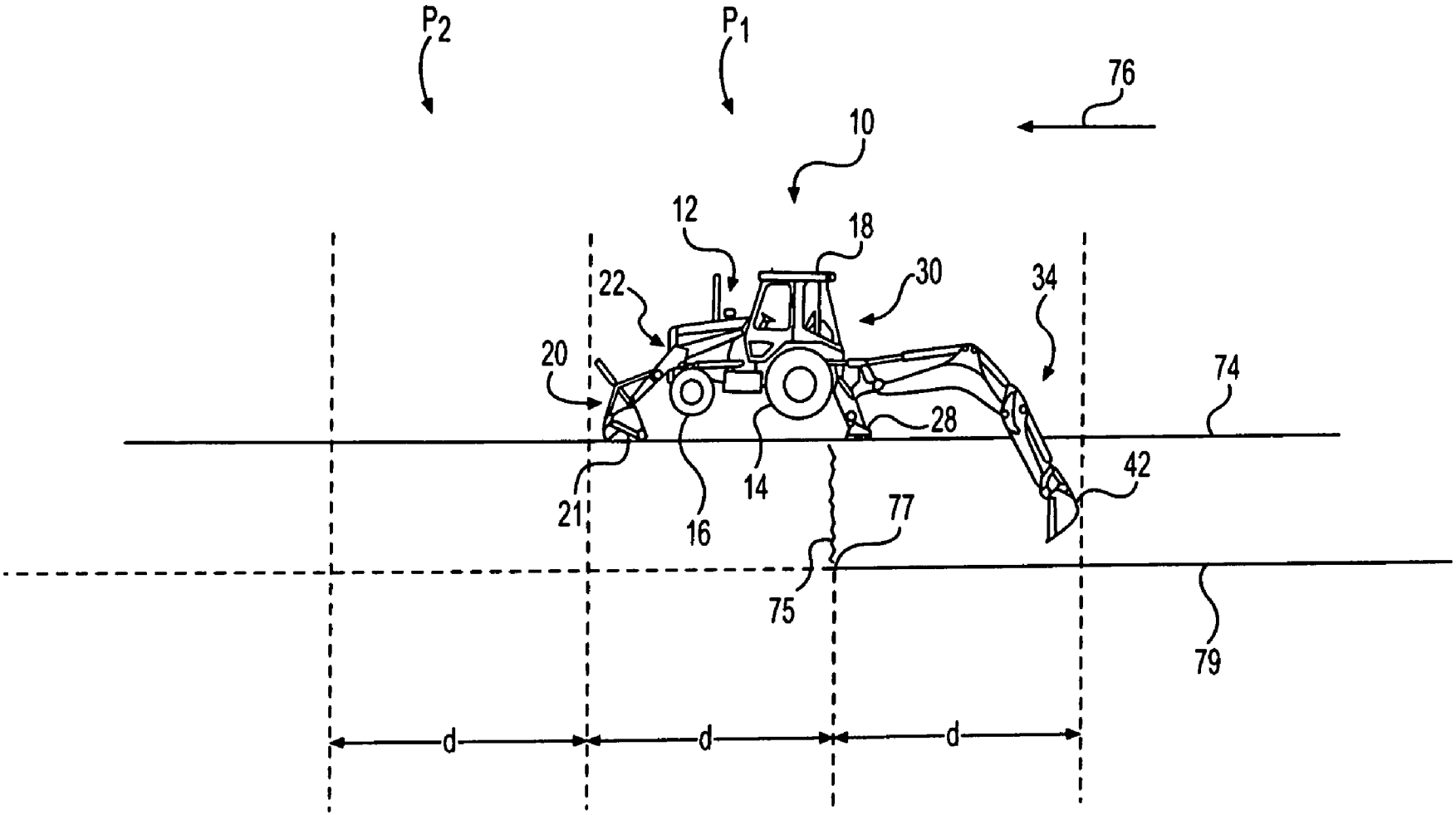
FIG. 4 is a side view of a trenching operation according to an exemplary disclosed embodiment.

FIG. 3 is a diagrammatic illustration of a tractor 12, for example the tractor of a backhoe loader 10, set up in position $P_1$ for excavating an elongated trench 74. Tractor 12 may be anchored in position by the outstretched stabilizers 28, aided by the loader bucket 21. In other words, the two outstretched stabilizers 28, along with the loader bucket 21, pressed firmly against the ground by the operating linkage 24 and actuators 26 and 27 (see FIG. 1), may hold the tractor 12 in a stationary position while the excavating assemblage 34 performs trenching operations within the range of movement of the pivotally mounted boom 38, stick 40, and bucket 42 (FIG. 1) of the excavating assemblage 34. FIG. 4 diagrammatically illustrates tractor 12 in side view supported by stabilizers 28 and loader bucket 21. The trench 74 is diagrammatically shown in FIGS. 3 and 4 as being of greater continuous extent than the working reach of the excavating assemblage 34, as is usually the case in actual practice, with the excavated portion in solid lines and the proposed, but as yet unexcavated portion in dotted lines. The direction in which digging along the trench proceeds is represented in FIGS. 3 and 4 by the arrow 76.

In FIGS. 3 and 4, the distance d designates the working reach of the excavating assemblage 34 at a single set-up position of the tractor 12. This working reach d represents the distance along the trench 74 that the excavating assemblage 34 can dig and still maintain the design depth of the trench and keep the bottom, or floor, of the trench reasonably smooth and free of substantial irregularities. Of course, the working reach d of a particular machine may vary, depending on a number of site specific factors. In particular, as the design depth of the trench increases, the working reach d will decrease. Another factor which may have some effect on the working reach d may be the type of material (rocky soil, wet clay, sandy soil, for example) being excavated. Additionally, the shape and size of the particular bucket 42 employed in a trenching operation may affect the working reach d. Suffice it to say that the working reach d may vary with site conditions, but it is determinative of when tractor 12 is to be repositioned from a current set-up position, such as $P_1$ to a new set-up position, such as $P_2$.

After excavating the trench 74 to the design depth, and as close to the tractor 12 as is practical, the tractor 12 must be repositioned before excavating may continue. Thus, referring to FIGS. 3 and 4, tractor 12 may be repositioned to position $P_2$ by moving tractor 12 in the direction of arrow 76 by the distance d. The excavating assemblage 34 at the rear portion 30 of tractor 12 will then be in a position for a new excavating phase to excavate a new section of trench 74 within a working reach d located in the area where tractor 12 had been set-up at position $P_1$ for the previous excavating phase. This distance d (designated d since it is equivalent to the working reach) may be referred to as the "hop distance" or the "repositioning distance," for example. Where the term "hop distance" or "repositioning distance" is used in this description, it will be understood to refer to the distance an excavating machine, such as a hydraulic excavator or a backhoe loader, is moved between excavating phases in order to continue an excavation, such as a trench. Thus, referring to FIGS. 3 and 4, for example, the distance d for machine movement from position $P_1$ to position $P_2$ would be a hop distance or repositioning distance, as well as the working reach.

Ideally, for greatest efficiency of operation, the number of times a hydraulic excavator or the tractor 12 is repositioned during a trenching operation should be kept to a minimum. One goal for an excavating operation is to move the machine, during the repositioning phase, the maximum distance that it can be moved and still effectively reach the end of the bottom of the trench already excavated, while minimizing the number of hops or repositioning phases needed to complete the continuous trench. Time devoted to machine repositioning is down time insofar as completing the trench is concerned because the machine is not digging when it is being repositioned.

Referring to FIG. 4, the trench already excavated (to the right in FIG. 4) includes an end 75 and a point 77 where the end 75 intersects the completed bottom 79 of trench 74. Taking as an example that the illustrated backhoe loader 10 can effectively excavate up to end 75 and point 77 from position $P_1$, backhoe loader 10 should be able to effectively reach the bottom 79 of trench 74 at point 77 with excavating assemblage 34 and continue the creation of a smooth trench bottom for a newly excavated trench section when repositioned to position $P_2$. Repositioning of a hydraulic excavator or the tractor 12 should be consistently for the same hop distance at each repositioning phase when the trenching depth remains constant, and that distance should be as close as possible to the working reach d. Of course, should the design depth of the trench 74 or other site conditions change as the excavating operation progresses, the working reach d could vary from one set-up position to another.

A "hop" distance d, or repositioning distance d, may be recommended to an operator performing a trenching operation with a backhoe loader or a hydraulic excavator. Ordinarily, an operator may use discretion and estimate a proper repositioning distance. It will be apparent that such an estimation may vary from one hop to another, as well as with the skill and experience of the operator. The recommended hop distance may be the greatest distance the machine can move forward, while still permitting the digging bucket to reach the bottom of the trench that has already been dug, and cleanly continue to dig the bottom of the trench and otherwise complete the trench to design specifications.

The maximum distance that a backhoe loader or a hydraulic excavator may move during a hop or repositioning phase may be based upon a variety of factors. For example, factors such as the geometry of the machine, including the effective lengths of the fully extended boom, stick, and bucket, affect a machine's working reach and, thus, the maximum distance for repositioning. The manner in which the bucket must dig into the soil (i.e., the required angle of the bucket relative to the stick and the trench bottom in order to be able to dig the bottom of the trench), the type of soil encountered, and the design depth of the trench all affect the maximum distance for machine repositioning between excavating phases.

Any of the factors of machine geometry, type of bucket employed, type of soil expected, etc., may be pre-programmed into the machine's control module, or in some cases sensed by the machine. For example, the machine may include an appropriate sensor to sense what type of bucket is currently attached using conventional radio frequency identification (RFID) technology. Alternatively, the operator may make a manual selection for entry of appropriate factor data into the control module via, for example, a suitable input device such as input/display device 54. The depth of the trench may be calculated using data from conventional sensors such as, for example, angle sensors or hydraulic cylinder position sensors.

Another way to sense trench depth may include keeping track of where the operator has been digging by, for example, having a virtual map in the memory of the control module to show what has been dug, and to provide indication of the vertical position of the trench floor based on a current location. Alternatively, a digging plan may be loaded into the memory of the control module to give an indication of the trench depth at a given, known machine location. As another alternative, the depth may simply be manually entered into the control module by the operator. When the various factors affecting the maximum machine repositioning distance are known, the machine may use them to calculate the maximum distance to be moved by, for example, employing a suitable equation or accessing a look-up table.

In an exemplary embodiment of the disclosure, a control module, such as an ECM, may be programmed to calculate and recommend an efficient permissible distance that a hydraulic excavator or a backhoe loader may be moved during a repositioning phase. An efficient permissible distance may be defined as a hop distance or repositioning distance that, under the circumstances, is the greatest distance that a machine may move during a repositioning phase and maintain greatest or optimum efficiency in a trenching operation. The efficient permissible distance may be the maximum permissible distance or an optimum permissible distance under the given circumstances of machine geometry, type of material being excavated, etc. For example, control module 52 may be programmed to calculate and recommend an efficient permissible distance for tractor 12 to move during a repositioning phase. The program for calculating and recommending the efficient permissible distance may be initiated by a machine operator. For example, the machine operator may conveniently activate a suitable virtual button on input/display device 54 while seated in seat 78 and positioned facing toward the machine rear 30 and excavating assemblage 34.

Figure 5:
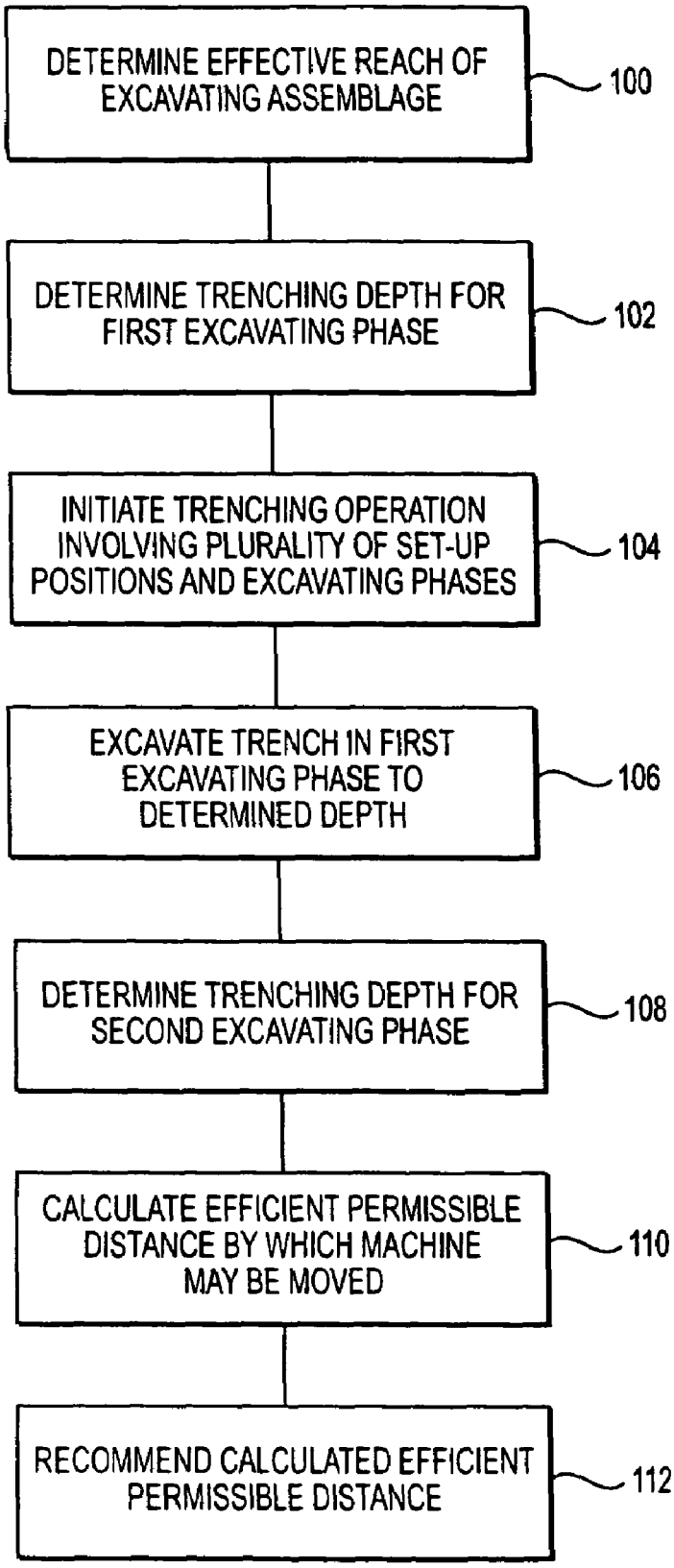
FIG. 5 is a flow chart according to an exemplary disclosed embodiment.

FIG. 5 diagrammatically illustrates, in flow chart form, one possible process for automating the recommendation of a repositioning distance. While certain actions of the process are indicated in FIG. 5, as well as indicated in a particular sequence for purposes of explanation, it should be understood that this is exemplary, and that the sequence of actions may be other than that illustrated in FIG. 5. In addition, the actions that occur also may vary from the exemplary embodiment of FIG. 5.

Referring to FIG. 5, at step 100 the effective reach of the excavating assemblage being employed for excavating a trench 74 is determined. This effective reach is determined based on a number of factors, at least some of which may be site specific. For example, the actual combined reach of the boom, stick, and bucket, when extended by their respective actuators, may be determined by the known dimensions and geometry of these elements. The presence or absence of an extendable stick (e-stick) is another factor that must be considered. Site specific factors include the size and type of bucket employed, and the type and consistency of the material being excavated. For example, in sand or loose soil, machine power and component strength may be sufficient to effectively excavate to the fully extended position of the boom, stick, and bucket. On the other hand, where very rocky ground, hard shale ground, or frozen ground is encountered, it may not be feasible to excavate at the fully extended position of the boom, stick, and bucket. Based on these various factors, for example, the effective reach may be determined. Information on all the foregoing factors may be entered into the control module via a suitable input device such as, for example, input/display device 54.

At step 102, the trenching depth for a first excavating phase is determined. This, for example, may be based simply on the design depth which may have been dictated by the proposed end use of the trench. Once the effective reach is determined at step 100 and the trenching depth is determined at step 102, the working reach d (FIGS. 3 and 4) becomes known. Conveniently, in order to establish a frame of reference, the trenching depth may be determined relative to a fixed point on the machine when the machine is in a set-up position and leveled. At step 104, a trenching operation is initiated, involving for its completion a plurality of set-up positions and a plurality of excavating phases. At step 106, the excavating assemblage is employed during a first excavating phase to excavate a trench to the depth determined for the first excavating phase and with a working reach d.

The trenching depth for a second excavating phase to immediately succeed the first excavating phase is determined at step 108. At step 110, an efficient permissible distance is calculated by which the machine may be moved while permitting trench excavation by the excavating assemblage during the second excavating phase to the depth determined for the second excavating phase and with a smooth, well-formed trench bottom. At step 112, based on the calculated result, an efficient permissible distance is recommended.

The recommended efficient permissible distance may be, for example, the maximum permissible distance the machine may be moved while permitting trench excavation by the excavating assemblage, the optimum permissible distance the machine may be moved while permitting trench excavation by the excavating assemblage, or some other distance that, given the surrounding circumstances, enhances the efficiency of the trenching operation beyond that subject to the vagaries of operator judgment. The recommendation may, for example, be recommended to a machine operator via input/display device 54. Alternatively, the recommendation may be displayed on some other display device located proximate a machine control station, for example a display located in cab 18. The recommendation, in addition to or in lieu of being displayed, may include programming the control module 52 to move the machine the recommended distance.

It will be understood that the recommended efficient permissible distance is, in fact, a recommendation which may suitably be overridden by the operator in the situation where control module 52 is programmed with the recommended efficient permissible distance. In situations where the recommended efficient permissible distance is displayed to the operator, but control module 52 is not programmed to move the machine the recommended distance, the operator may, based on discretion, site conditions, or other factors, choose not to follow the recommendation.

Once an excavating phase has come to an end and it becomes necessary to move the machine to a new set-up position in order to continue a trenching operation, a number of actions may be necessary to prepare the machine for repositioning. One exemplary embodiment of the disclosure in which the machine may be prepared for repositioning from a current set-up position to the next successive set-up position is diagrammatically illustrated in FIG. 6 in the form of a flow chart. While the actions are indicated in a particular sequence in FIG. 6, it should be understood that this is exemplary, and that the sequence of actions may be other than that illustrated in FIG. 6. In addition, one or more of the actions indicated may, in a given situation, be omitted. Additionally, the identified actions should not be construed as exclusive of other actions that may be included in given circumstances.

Figure 6:
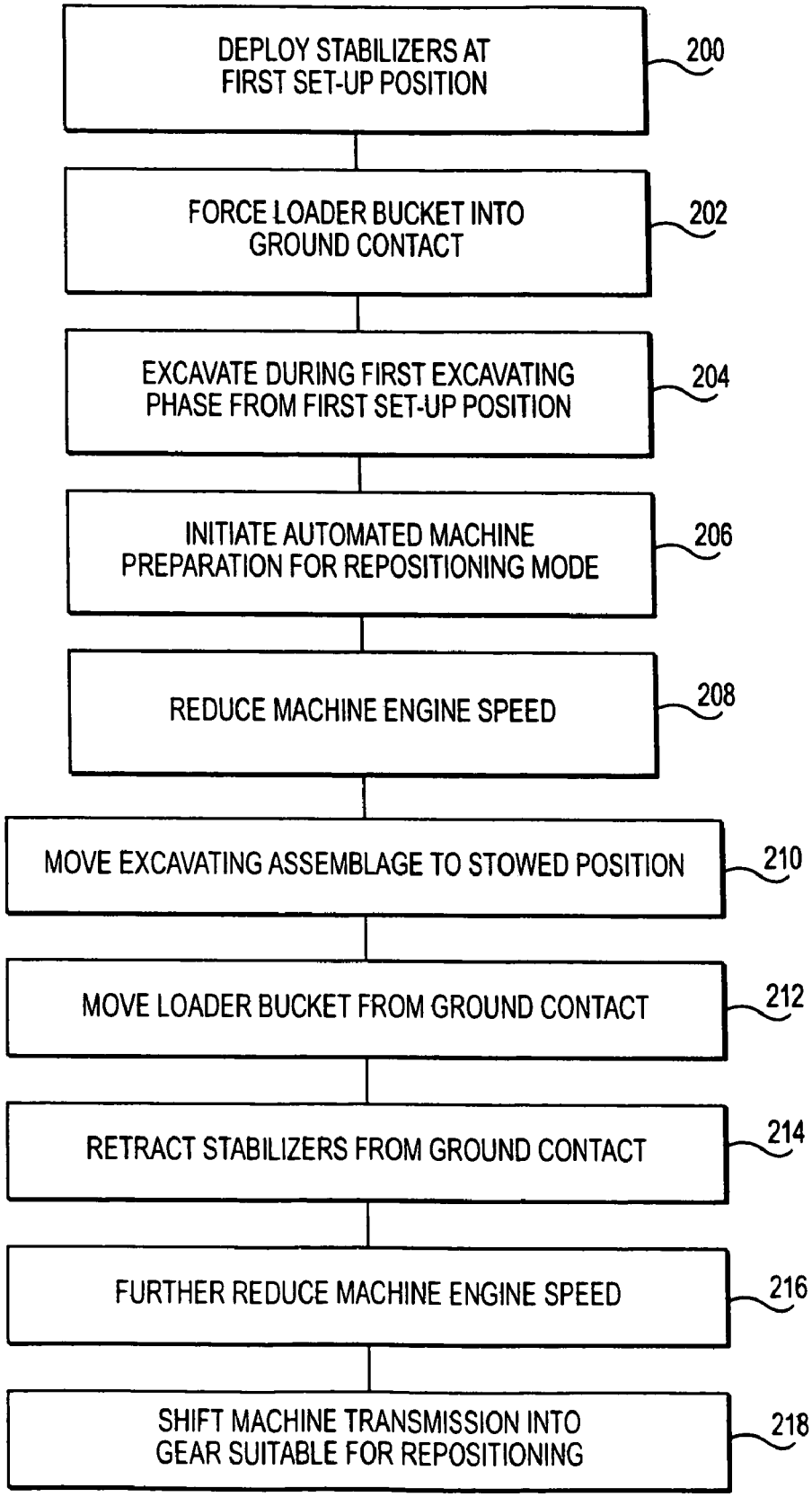
FIG. 6 is a flow chart according to another exemplary disclosed embodiment.

Referring to FIG. 6, the process may begin with the machine suitably located for initiating a trenching phase. At step 200, stabilizers 28 may be deployed to ground contact to stabilize the machine at a first set-up position. At step 202, loader bucket 21 may be forced into ground contact via operating linkage 24 and actuators 26 and 27. Together, the two stabilizers 28 and the loader bucket 21 may raise the machine such that the ground engaging wheels 14 and 16 are out of ground contact and the machine is suitably leveled (see FIG. 4). Once stabilized and leveled, excavating with the excavating assemblage 34 during a first excavating phase from the first set-up position may occur at step 204.

Once trenching at the first set-up position is completed, the operator may initiate, at step 206, an automated machine preparation for repositioning mode for preparing the machine, after the excavating phase, for repositioning to a second set-up position for a second excavating phase. This initiation may take place by activating an input device to send input signals to a controller, such as control module 52. For example, input/display device 54 may include a virtual button on a touch screen suitably configured to send, when activated, a signal to control module 52 to initiate the automated machine preparation for repositioning mode. Alternatively, initiating the automated machine preparation for repositioning mode may be accomplished with a toggle switch, a button, a control lever, or any other suitable input device.

Once the automated mode has been initiated at step 206, a number of subsequent actions may occur. Since machine speed ordinarily is relatively high during an excavating phase in order to accommodate the loads inherent in the act of excavating, machine engine speed is reduced at step 208 to a level below the machine engine speed employed during excavating. At step 210, the excavating assemblage 34 is moved to a stowed position, at step 212, loader bucket 21 is moved from ground contact, and at step 214, stabilizers 28 are retracted from ground contact.

At step 216, machine engine speed is further reduced, and at step 218, the machine transmission is shifted into a gear suitable to facilitate machine repositioning. Reduction of machine engine speed at step 216 may include reduction of engine speed to idle speed responsive to output signals delivered from control module 52. Reduction to idle speed may aid the shifting of the transmission into a suitable gear for machine repositioning at step 218.

In another exemplary embodiment of the disclosure in which the machine may be in the process of repositioning from a current set-up position to the next successive set-up position, the operator may suitably control propulsion and steering of the tractor 12 by an input device otherwise employed to control the excavating assemblage 34. Generally, a backhoe loader is driven from one location to another by an operator seated facing the front of the machine, usually by manipulating a steering wheel, a brake pedal, an accelerator pedal, etc. During excavating with the rear mounted excavating assemblage 34, the operator generally is seated facing the rear of the machine. A common expedient by which the operator may face in a forward direction for driving the tractor forward (such as during moving from one location to another or during operation of the front loader assembly 20) is a rotating seat 78.

Employing the rotating seat expedient, an operator may rotate the seat 78 from the rear facing direction (illustrated in FIG. 1), used during excavating with excavating assemblage 34, to a front facing direction for forward movement of the tractor 12 during a repositioning phase. While in the rear facing direction, the operator may suitably control an input device or devices to operate the excavating assemblage 34, including the swing mechanism 36, the boom 38, the stick 40 (and e-stick if present), and the bucket 42. On the other hand, while in the front facing direction, the operator may suitably control machine steering by, for example, a steering wheel 72. In addition, the operator may suitably control propulsion (or engine speed) by, for example, a pedal 70.

Figure 7:
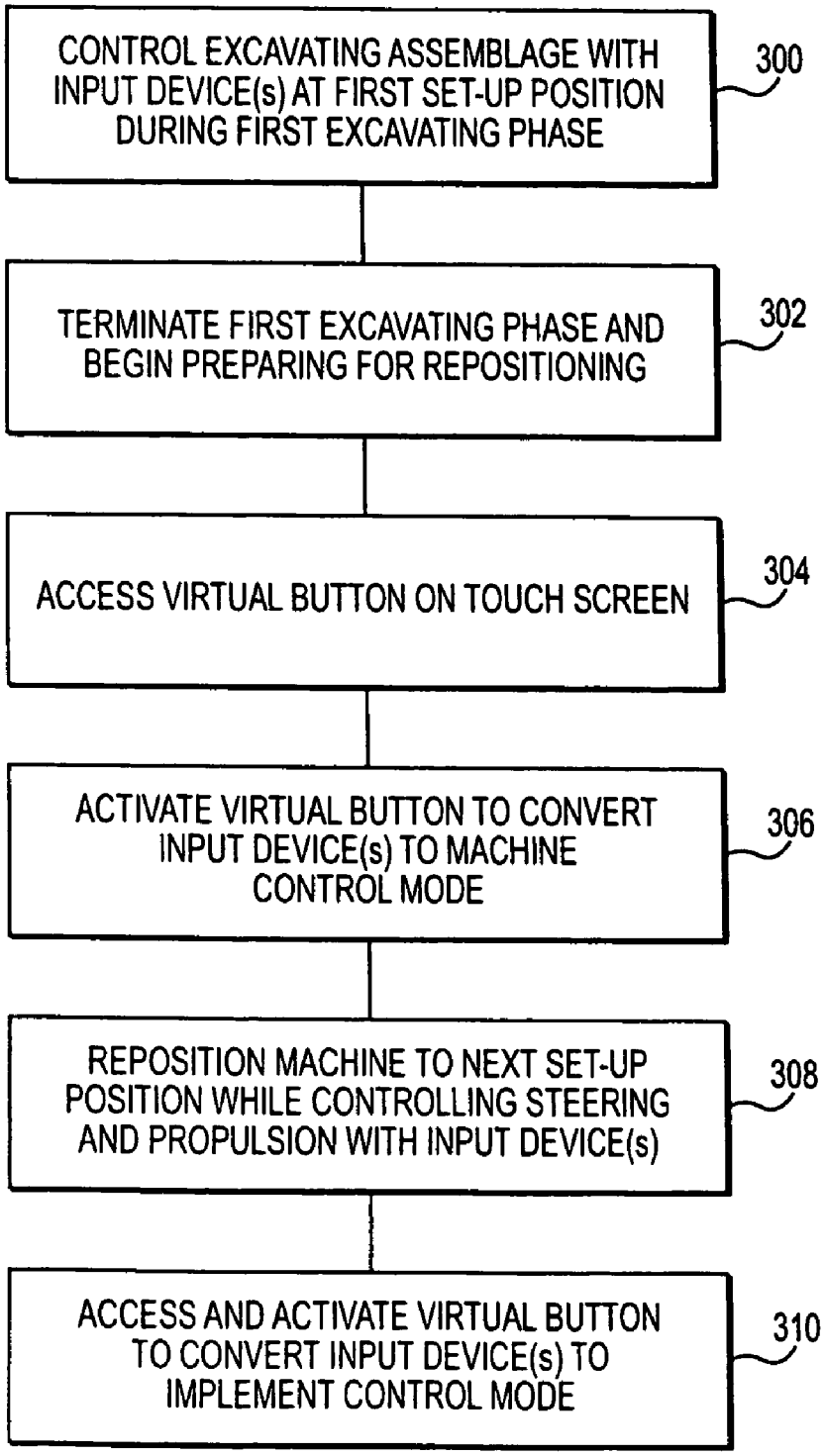
FIG. 7 is a flow chart according to another exemplary disclosed embodiment.

In FIG. 7, an exemplary disclosed embodiment for utilizing an input mechanism both for operating excavating assemblage 34 during an excavating phase, and for controlling steering and propulsion of tractor 12 during a repositioning phase, is diagrammatically illustrated in the form of a flow chart. Fully autonomous machine repositioning without operator intervention is difficult and expensive. However, with appropriate automation, an operator may be permitted to exercise control expertly (even though the operator may not be an expert operator). In this exemplary embodiment, a balance between operator control and autonomous operation may be achieved. For example, the machine operator may intervene and interrupt automated control, or the operator may retain control over one or both of steering and propulsion.

Referring now to FIG. 7, at step 300, the operator may control the excavating assemblage 34 with an input device (or input devices), such as 56 (FIG. 2), at a first set-up position to excavate during a first excavating phase. Here, there may be, for example, right and left joysticks, such as right joystick 92 and left joystick 90 (FIG. 2) accessible to an operator's right and left hands, respectively, as the operator faces toward the rear of the machine. In one embodiment, the right joystick 92 may control two functions of the excavating assemblage 34 and the left joystick 90 may control two other functions of the excavating assemblage 34. For example only, the right joystick 92 may control swing mechanism 36 and stick 40, while the left joystick 90 may control boom 38 and bucket 42. Obviously, the combinations and permutations by which the joysticks 90, 92 may be programmed may vary.

At step 302, the operator may have terminated the first excavating phase and initiated automated preparation for repositioning to the next set-up position for continued excavating. Here, the machine may be at some point in the process illustrated in FIG. 6 in preparation for repositioning. At this point, the operator may access a virtual button located on a touch screen display, at step 304, which may be a virtual button on the input/display device 54 illustrated in FIG. 2. At step 306, the operator may activate the virtual button to convert the input device (or input devices) to machine control mode. Where right and left joysticks comprise the input devices, one joystick may control propulsion and the other joystick may control steering. Alternatively, a single joystick may be converted such that, for example, forward and backward movement of the joystick controls propulsion (or engine speed) and side to side movement controls steering.

At step 308, the machine is repositioned to the next set-up position while the operator controls steering and propulsion via the input device or devices. Here, the operator may retain control of those functions over which the operator needs to maintain control. For example, the operator may retain control of a "go forward" command so that the machine does not move unless the operator initiates the command. To enable the operator to expertly stop the machine after it has moved a recommended distance to begin a new excavating phase, the controller may assist an operator initiated "stop" command. Thus, autonomous control and operator control act in synergy. The operator may remain facing toward the rear of the machine without the necessity of gaining access to the steering-wheel 72 and pedal 70. Once the second set-up position is reached, the operator, at step 310, may access a virtual button to convert the input device or devices back to implement control mode for controlling the excavating assemblage 34.

Control module 52 may include a processor and memory as known in the art. The memory may store one or more routines, which could be software programs, for controlling the excavating assemblage 34 as well as other machine components. For example, the memory may store routines for controlling the machine during automated preparation for repositioning mode. Control module 52 may be configured to receive information from various input devices and from various sensors that may be associated with the excavating assemblage 34 or other machine components. For example, in connection with operation of excavating assemblage 34, various angle sensors or cylinder position sensors (not shown) may be included for determining the position of various cooperating components and enabling calculation of trench depth.

INDUSTRIAL APPLICABILITY

Figure 8:
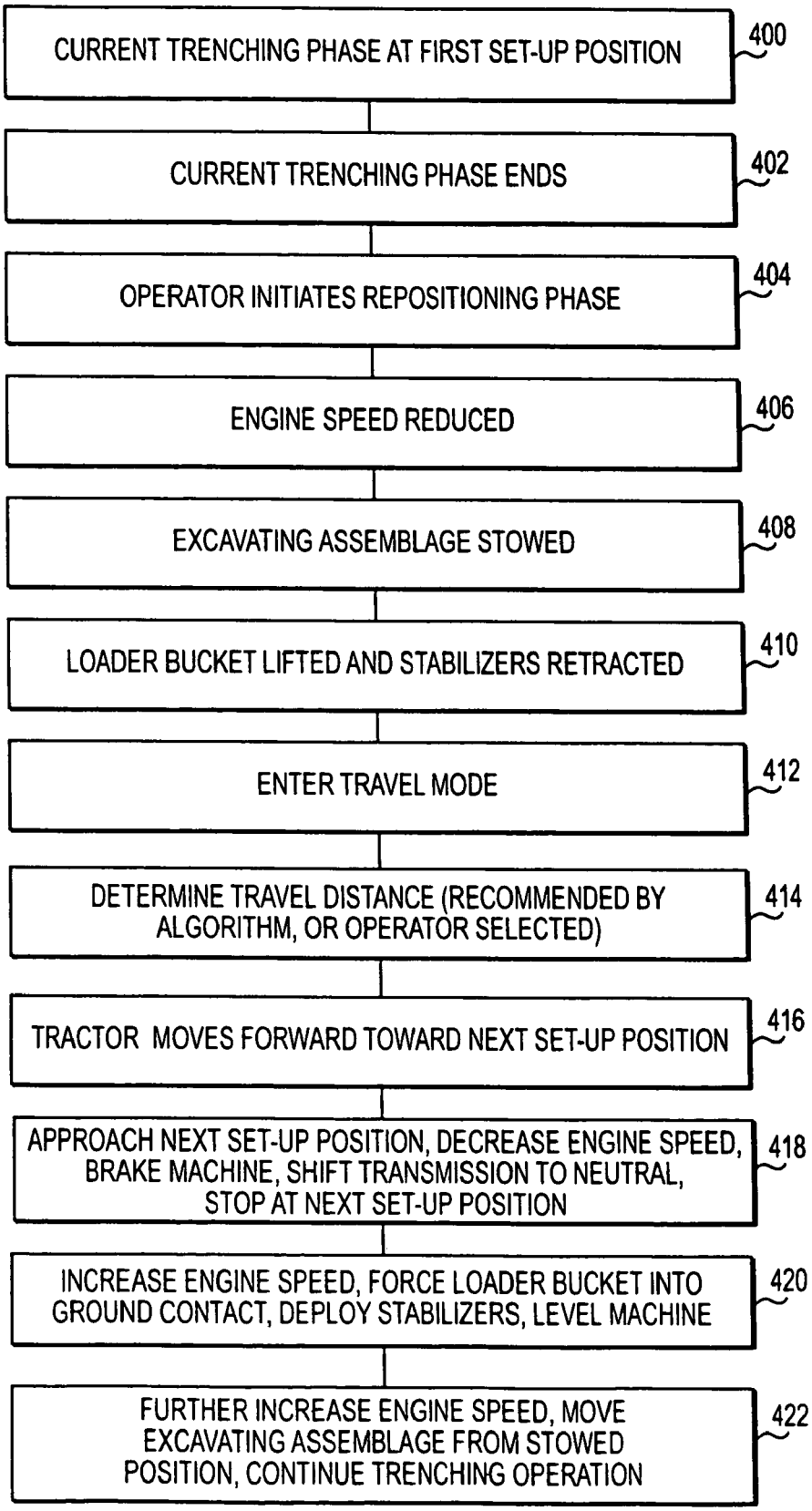
FIG. 8 is a flow chart according to another exemplary disclosed embodiment.

FIG. 8 discloses a fully automated process according to an exemplary disclosed embodiment. Upon start of the process at step 400, the operator may be in a current trenching phase at a first set-up position. During the trenching phase, the machine may be controlled to excavate a proposed trench with, for example, a backhoe loader 10. Since the proposed trench will be presumed to have a design length substantially greater than the extent to which the excavating assemblage 34 of the backhoe loader 10 can excavate from a single set-up position, it will be necessary to reposition the tractor 12, perhaps multiple times, in order to complete a continuous excavation to the design length. Accordingly, as the operator completes the current trenching phase by excavating to the design depth (which may vary according to the intended use of the trench) and as close to the tractor as is reasonable the current trenching phase may come to an end at step 402. Then, the operator may be ready to move the tractor forward to a new set-up position in order to begin the next trenching phase.

At step 404, the operator initiates a repositioning phase. The repositioning phase may be initiated by moving a physical switch or lever, for example. Alternatively, the repositioning phase may be initiated by appropriately activating a virtual button on a touch screen display, such as input/display device 54 (FIG. 2). It will be recognized by those having skill in the art that these are merely examples of activating expedients, and that any other known expedient for initiating a programmed operation may be employed. Once the repositioning phase is initiated, a series of events may then take place to reposition the tractor 12 to a new set-up position.

At step 406, the engine speed may be reduced. Engine speed during an excavating phase may be relatively high in order to support the hydraulic system and the various hydraulic components that drive the excavating assemblage 34, for example. However, engine speed need not be nearly so high for non-excavating functions, such as those that take place during a repositioning phase. Engine speed may be reduced as, or just before, the excavating assemblage 34 is moved to stowed position preparatory to repositioning. Alternatively, or additionally, engine speed may be reduced after the excavating assemblage 34 is moved to stowed position and as the loader bucket 21 is lifted and/or the stabilizers 28 are retracted.

At step 408, the excavating assemblage 34 may be moved to a stowed position out of the trench 74 and clear of ground contact. In this position, bucket 42 may be curled relative to stick 40, the stick 40 and bucket 42 may be pivoted into close proximity to the boom 38, and the entire assemblage may be centered relative to the tractor 12 by the swing assembly 36.

At step 410, the loader bucket 21 may be lifted from ground contact and stabilizers 28 may be retracted from ground contact. Movement of loader bucket 21 and stabilizers 28 may take place sequentially, simultaneously, or partly sequentially and partly simultaneously. This lifting of the loader bucket and retracting of the stabilizers allow the ground transportation wheels 14, 16 (or other ground transportation expedients such as tracks) to then fully support the tractor 12 in preparation for movement to the next set-up position.

Once the excavating assemblage 34 is stowed, the loader bucket 21 is lifted, and the stabilizers 28 are retracted, ground supporting wheels 14, 16 contact the ground and tractor 12 enters travel mode at step 412. Travel mode is entered by reducing engine speed further down to, for example, a low idle, allowing the transmission 61 to be smoothly placed in gear. After a slight delay encountered while the transmission 61 moves into an appropriate gear, engine 60 speed may increase somewhat in order to move the tractor 12 forward.

Up until this point, the series of activities from the time the repositioning phase is initiated until just before the tractor 12 begins to move forward may be designated as an automated preparation for repositioning mode (see FIG. 6, for example). During this automated preparation for repositioning mode, it will be understood that, from the time the repositioning phase is initiated at step 404, the activities including stowing the excavating assemblage 34, removing the loader bucket 21 from ground contact, retracting the stabilizers 28, reducing engine speed, and engaging a transmission gear appropriate for repositioning may all occur automatically, without manual intervention by the machine operator.

At some point, the travel distance during a machine repositioning phase may be determined. This determination may occur at any number of points in time. For example, as illustrated in FIG. 8, this determination may occur at some time after entry into travel mode. As indicated at step 414 in FIG. 8, travel distance may be determined, and this determination may either be by way of a recommendation by a suitable algorithm (see the discussion relevant to the embodiment illustrated in FIG. 5), or by operator selection.

At step 416, the tractor 12 may move from the current set-up position toward the next set-up position. The control system 50 may be programmed for semi-automation. The operator may manipulate one or more joysticks, or one or more suitable pedals, to command forward movement of the machine. During this movement, either or both of the steering and propulsion of the tractor 12 may be controlled by the operator through, for example, right joystick 92 and/or left joystick 90. Steering and propulsion of the tractor 12 via joystick control may be by one or more joysticks that may be converted from implement control mode to machine movement control mode in accordance with the discussion of the embodiment illustrated in FIG. 7. In this way, an operator need not change positions, such as by rotating seat 78, for example, and may use the same joystick or joysticks that are used to control the excavating assemblage by converting to steering and propulsion control mode. Control of steering and/or propulsion may thus remain with the operator. The operator may then suitably intervene to avoid any site obstructions or otherwise address safety concerns. Additionally, the operator maintains the sense of being in control, even though some functions are automated.

At step 418, tractor 12 approaches a programmed or desired distance for a new set-up location. As the distance moved approaches the desired repositioning or hop distance (such as, a recommended distance) that has been set, the machine may slow down regardless of operator input. This semi-automatic control gives the operator the control that may be needed while ensuring that the target distance is accurately achieved. If the operator, inadvertently or otherwise, attempts to exceed the target distance, the operator's input is overridden. Thus the machine stops at the target distance. This strict control of the repositioning or hop distance permits maximizing the distance between excavating phases, while still ensuring a smooth trench bottom and minimizing the time and effort that must be expended on the excavating operation.

As the machine approaches the new set-up location, the engine speed again may decrease to a low idle, machine brakes may engage, and the transmission may shift to neutral as the machine slows down and comes to a smooth stop. Control module 52 may determine when the machine has traveled the target distance to the new set-up position. Any suitable distance determining expedient, such as a GPS tracking system or an inertial tracking system, for example, may be employed to determine how far the machine has moved. The tractor 12 may come to a smooth stop at the designated new set-up location, such as at a recommended efficient permissible distance from the first set-up position as determined in accordance with the procedure described in connection with FIG. 5. Once tractor 12 has come to a stop, transition from repositioning phase to excavating phase may begin.

At step 420, the engine speed may be increased to support lowering of the loader bucket 21 and stabilizers 28. The loader bucket 21 may be forced into ground contact and the stabilizers 28 may be deployed, all with sufficient force to raise and level the machine into a position supported by the loader bucket 21 and the stabilizers 28. In this position, the ground transportation wheels 14, 16 may be entirely out of contact with the ground (see FIG. 4).

At step 422, the engine 60 may increase speed to the level that supports an excavating phase. The excavating assemblage 34 may be moved from the stowed position to a position ready to resume trenching. Trenching may then be continued from the new set-up position within the working limits of the excavating assemblage or until the trench is finished.

It will be understood that the process schematically illustrated in FIG. 8 and described above is an exemplary embodiment which may vary. For example one or more actions identified in connection with FIG. 8 may be omitted in a given situation. Furthermore, it may be desirable in a given situation to include other actions not identified in connection with FIG. 8. In addition, the semi-automatic mode of operation may be applicable in situations where machine functions, such as steering and propulsion, are performed by input devices other than joysticks. For example, the control system may be configured such that the operator may initiate forward movement with a pedal, such as pedal 70 in FIG. 1, and the controller may stop the machine forward movement at a desired or pre-programmed position. This semi-automatic control may be used either during a hop or repositioning phase or during other forward machine movement. In addition, such semi-automatic control, wherein the operator initiates movement and a machine controller stops movement, is applicable to machines other than backhoe loaders, such as, for example, a hydraulic excavator.

Delays and inefficiencies are an ordinary part of an excavating operation requiring a plurality of set-up positions for its completion. By utilizing various expedients, including automation, such delays and inefficiencies may be avoided. For example, an efficient, permissible distance for machine repositioning between excavating phases in a trenching operation may be calculated and recommended under complete automation in order to enhance efficiency. As another example, certain preparation activities that occur upon termination of an excavating phase and prior to machine repositioning may be automated. As a further example, during machine repositioning, an implement control input device or input devices may be suitably converted to a mode for controlling machine steering and propulsion in order, among other things, to obviate the need for repositioning the operator seat.

The repositioning distance a machine must move from one set-up position to the next over the course of an extended trench excavating operation ordinarily is left to operator judgment and discretion. Because an efficient permissible distance for repositioning may be calculated and recommended to the operator based on numerous measured variables, reliance for best, maximum, and/or optimum distance to move between one set-up position and the next need not be left to operator discretion based on estimations. Since a consistent and efficient distance may be immediately available to the operator and actually programmed into the machine, the trench may be more efficiently excavated and, particularly with a trench of significant length, substantial time may be saved.

The actions which ordinarily take place in preparation for repositioning between set-up positions may be individually initiated by the machine operator. Aside from being one more fatigue factor, the efficiency and consistency of this series of actions may vary considerably, depending on the skill and experience of the operator. By automating the preparation for repositioning procedure, operator fatigue is reduced and efficiency and consistency of overall machine operation is enhanced. A novice operator may be able to operator a machine with the efficiency of an expert.

Because the machine operator may conveniently access an on-board touch screen display and activate a virtual button to convert an input device or devices from excavating assemblage control to steering and propulsion control, and vice versa, the operator need not move back and forth between the controls for the excavating assemblage (at the machine rear) and the controls for steering and propulsion (at the machine front). The touch screen display and instant conversion from one mode to another eliminates operator fatigue factors that are unavoidably a part of heavy equipment operation. Employing a touch screen for converting an input device or devices from one mode to another constitutes a safety feature since inadvertent conversion from one mode to another is more improbable than it would be where a switch or button, closely associated with the input device (such as a joystick) is employed.

Numerous actions are involved in the overall repositioning process between set-up positions in an excavating operation. Because the overall process may be automated, a significant reduction in operator fatigue and allowance for variance in operator skill and experience are realized. By retaining the option for operator intervention to control certain aspects of the repositioning process, such as machine speed, the desirable involvement in the process by the machine operator is retained for safety and error correction.

While the disclosed system and method have been described and illustrated in connection with a typical backhoe loader, it should be understood that other types of excavating assemblages, such as a hydraulic excavator, for example, may benefit from employing the disclosed system and method.

It will be apparent to those skilled in the art that various modifications and variations can be made to the disclosed system and method without departing from the scope of the disclosure. Other embodiments will be apparent to those skilled in the art from consideration of the specification and practice of the disclosed embodiments. It is intended that the specification and examples be considered as exemplary only with the true scope of protection being indicated by the following claims.

What is claimed is:

1. A method of excavating a trench with a backhoe loader machine, the backhoe loader machine including an engine, a backhoe mechanism at the rear of the machine, and a front loader assembly at the front of the machine, comprising:

setting up the backhoe loader machine at a first position suitable for forming the trench by deploying a pair of stabilizers into ground contact, excavating a portion of the trench with the backhoe mechanism during a first excavating phase while the backhoe loader machine is set up at the first position;

moving the backhoe mechanism to a stowed position;

retracting the pair of stabilizers;

determining a target distance and path for moving the backhoe loader machine to a second position suitable for excavating another portion of the trench during a second excavating phase;

moving the backhoe loader machine forward for the target distance while steering the backhoe loader machine along the target path;

stopping the backhoe loader machine at the second position under automated machine control;

setting up the backhoe loader machine at a second position by deploying the pair of stabilizers into ground contact; and excavating a portion of the trench with the backhoe mechanism during a second excavating phase while the backhoe loader machine is set up at the second position.

2. The method of claim 1, further including forcing a loader bucket of the front loader assembly into ground contact during setting up the backhoe loader machine at the first position and at the second position, and retracting the loader bucket from ground contact after moving the backhoe mechanism to a stowed position.

3. The method of claim 1, further including increasing engine speed to a level sufficient to support the stresses involved in excavating with the backhoe mechanism prior to excavating a portion of the trench with the backhoe mechanism at the first position and at the second position.

4. The method of claim 3, further including reducing engine speed prior to moving the backhoe mechanism to a stowed position, and reducing engine speed further and engaging a transmission gear suitable for machine movement prior to moving the machine forward.

5. The method of claim 4, further including increasing engine speed after engaging a transmission gear suitable for machine movement.

6. The method of claim 5, further including decreasing engine speed, applying machine brakes, and disengaging the transmission gear on approach to the second position.

7. The method of claim 6, further including increasing engine speed prior to setting up the backhoe loader machine at the second position.

* * * * *